US011623114B2

(12) United States Patent
Mohieldin et al.

(10) Patent No.: US 11,623,114 B2
(45) Date of Patent: Apr. 11, 2023

(54) REMOTE-SENSING, BLUETOOTH-ENABLED RESISTANCE EXERCISE BAND

(71) Applicants: Trustees of Dartmouth College, Hanover, NH (US); Mary Hitchcock Memorial Hospital, for itself and on behalf of Dartmouth Hitchcock Clinic, Lebanon, NH (US)

(72) Inventors: Suehayla Mohieldin, Bethesda, MD (US); Ryan J. Halter, Lyme, NH (US); John A. Batsis, Chapel Hill, NC (US); Colin Minor, Southport, NC (US); Curtis Lee Petersen, Portland, OR (US)

(73) Assignees: Trustees of Dartmouth College, Hanover, NH (US); Mary Hitchcock Memorial Hospital, for itself and on behalf of Dartmouth Hitchcock Clinic Lebanon, Lebanon, NH (US)

( * ) Notice: Subject to any disclaimer, the term of this patent is extended or adjusted under 35 U.S.C. 154(b) by 17 days.

(21) Appl. No.: 17/335,986

(22) Filed: Jun. 1, 2021

(65) Prior Publication Data

US 2021/0370122 A1 Dec. 2, 2021

Related U.S. Application Data

(60) Provisional application No. 63/033,022, filed on Jun. 1, 2020.

(51) Int. Cl.
*A63B 21/00* (2006.01)

(52) U.S. Cl.
CPC .... *A63B 21/00043* (2013.01); *A63B 2220/51* (2013.01); *A63B 2220/58* (2013.01);
(Continued)

(58) Field of Classification Search
CPC ..... A63B 21/00043; A63B 24/0062; A63B 2220/51; A63B 2220/58; A63B 2220/833;
(Continued)

(56) References Cited

U.S. PATENT DOCUMENTS 3,510,130 A * 5/1970 Ferdinand ..... A63B 21/00043 73/379.08
3,640,530 A * 2/1972 Henson ..... A63B 21/153 73/379.06

(Continued)

FOREIGN PATENT DOCUMENTS

WO 2017179997 A1 10/2017
WO 2019222630 A1 11/2019
WO WO-2019222630 A1 * 11/2019 ..... A63B 21/00043

OTHER PUBLICATIONS

Minor, Colin, BandPass: Development and commercialization of a remote-sensing, internet-enabled resistance exercise band (submitted Sep. 14, 2020 for ENGG 390: Master of Engineering Management Project), 48 pages.

(Continued)

*Primary Examiner* — Andrew S Lo
*Assistant Examiner* — Andrew M Kobylarz
(74) *Attorney, Agent, or Firm* — Neal, Gerber & Eisenberg LLP; Kevin A. O'Connor

(57) ABSTRACT

Devices and methods are disclosed for remote clinical monitoring performance of exercises using a smart resistance exercise device including a resistance band, a first handle connected to a first end of the resistance band and a second handle connected to a second end of the resistance band, a force sensing assembly operably coupled to the resistance band, and a local receiving device communicatively coupled to the force sensing assembly. The force sensing assembly of the device includes a housing, and a force sensor disposed in the housing and operatively con- (Continued)

nected to the resistance band to measure a force exerted on the resistance band. The force sensing assembly also includes a processing and communication module communicatively coupled to the force sensor to receive measurements of the force sensor and communicatively coupled to the local receiving device to transmit the measurements to the local receiving device.

11 Claims, 11 Drawing Sheets

(52) U.S. Cl.
CPC ..... *A63B 2220/833* (2013.01); *A63B 2225/20* (2013.01); *A63B 2225/50* (2013.01)

(58) Field of Classification Search
CPC ..... A63B 2225/20; A63B 2225/50; A63B 21/0557; A63B 21/0552; A63B 21/0414; A63B 21/0724; A63B 21/4035; A63B 71/0622; A63B 2071/0694; A63B 2220/34; A63B 2220/44; A63B 2220/56; A63B 2220/89; A63B 21/0722
See application file for complete search history.

(56) References Cited

U.S. PATENT DOCUMENTS 4,678,184 A * 7/1987 Neiger ..... A63B 21/0058 482/4
5,538,486 A 7/1996 France et al.
5,697,869 A * 12/1997 Ehrenfried ..... A63B 21/157 482/7
D892,237 S * 8/2020 Bentsen ..... D21/692
11,161,012 B1 * 11/2021 Hendricks ..... A63B 71/0054
11,389,699 B2 * 7/2022 Mallard ..... A63B 24/0087
2002/0086779 A1 * 7/2002 Wilkinson ..... A63B 23/1263 482/118
2014/0194250 A1 * 7/2014 Reich ..... A63B 24/0084 482/5
2014/0221164 A1 * 8/2014 Siniora ..... A63B 21/4049 482/46
2014/0287876 A1 * 9/2014 Etter ..... A63B 24/0087 482/5
2015/0170530 A1 6/2015 Damman et al.
2015/0253210 A1 9/2015 Ashby et al.
2016/0332019 A1 * 11/2016 Rollins ..... A63B 23/129
2017/0036063 A1 * 2/2017 Goldston ..... A63B 71/0622
2017/0304679 A1 * 10/2017 Orfield ..... A63B 21/0724
2018/0214729 A1 * 8/2018 Rubin ..... A63B 24/0087
2019/0269967 A1 * 9/2019 Thomas ..... G01L 5/047
2019/0290962 A1 * 9/2019 Osbrink ..... A63B 24/0062
2019/0344123 A1 * 11/2019 Rubin ..... A63B 24/0062
2020/0047055 A1 * 2/2020 Ward ..... A61B 5/6895
2020/0121968 A1 * 4/2020 Ismail ..... A63B 21/1681
2020/0289890 A1 * 9/2020 Kim ..... G01C 19/00
2021/0001171 A1 * 1/2021 Fung ..... A61B 5/4842
2021/0077849 A1 * 3/2021 Wehrell ..... A63B 21/063
2021/0086031 A1 * 3/2021 Thomas ..... G01L 5/047
2021/0128971 A1 * 5/2021 Orfield ..... A63B 71/0622
2021/0213329 A1 * 7/2021 Wechsler ..... A63B 21/4035
2021/0244995 A1 * 8/2021 Andrei ..... A63B 21/1663
2021/0339078 A1 * 11/2021 Akeel ..... A63B 24/0087
2021/0370122 A1 * 12/2021 Mohieldin ..... A63B 21/00043
2022/0176187 A1 * 6/2022 Falahi ..... A63B 21/169
2022/0233905 A1 * 7/2022 Bar ..... A63B 21/4013

OTHER PUBLICATIONS

Mohieldin, Suehayla. BandPass: A smart resistance exercise band to monitor strength. ENGS 88 Honors Thesis, Dartmouth College Digital Commons, https://digitalcommons.dartmouth.edu/engs88/8 (Spring Jun. 6, 2019), 81 pages.
Petersen et al. Detection and Monitoring of Repetitions Using an mHealth-Enabled Resistance Band. IEEE Int Conf Connect Health Appl Syst Eng Technol. Sep. 22-24, 2018, 6 pages.
Petersen et al. Remote Rehabilitation: A Field-Based Feasibility Study of an mHealth Resistance Exercise Band. IEEE Int Conf Connect Health Appl Syst Eng Technol. Dec. 5-6, 2020, 2 pages.
Petersen et al. Using Natural Language Processing and Sentiment Analysis to Augment Traditional User-Centered Design: Development and Usability Study. JMIR Mhealth Uhealth. 8(8):e16862 (Aug. 7, 2020), 13 pages.
Rolyan® Smart Handle, Patterson Medical (2014), 4 pages.
Wechsler et al. Development of a smart TheraBand to assess strength. Journal of the American Geriatrics Soc., D76 (Apr. 26, 2017), 1 page.

* cited by examiner

REMOTE-SENSING, BLUETOOTH-ENABLED RESISTANCE EXERCISE BAND

CROSS REFERENCE TO RELATED APPLICATIONS

This application claims priority to U.S. Provisional Application No. 63/033,022, filed on Jun. 1, 2020 and entitled "Remote-Sensing Bluetooth-Enabled Resistance Exercise Band," which is incorporated herein by reference in its entirety.

FEDERALLY SPONSORED RESEARCH OR DEVELOPMENT

This invention was made with government support under K23 AG051681 awarded by the National Institutes of Health, P30DA029926 awarded by the National Institutes of Health, and CNS-1314281 awarded by the National Science Foundation. The government has certain rights in the invention.

TECHNICAL FIELD

The present invention relates to a 'smart' resistance exercise device and, in particular, a 'smart' resistance exercise system that senses, quantifies, and transmits resistance exercise data (e.g., force profile) to a portable device such as a smart phone or smart watch.

BACKGROUND

Physical therapy is an important part of many multimodal treatment plans for musculoskeletal disability and weakness, particularly in older adults. Strength training using resistance exercises has proven efficacy in improving muscle strength in individuals with frailty or weakness.

For example, sarcopenia, the loss of muscle mass and weakness, is a recognized geriatric syndrome whose prevalence rates increase with age. As noted above, resistance bands are an integral part of any exercise program. This has been recommended in evidence-based guidelines by the American College of Sports Medicine, and through the National Institute on Aging Exercise Recommendations for Older Adults. In addition, sarcopenia has recently been granted an International Classification of Diseases $10^{th}$ edition code.

Resistance bands are routinely used within clinical and home-based settings to improve muscle strength. Some difficulties that arise with exercise in a home-based setting or otherwise unsupervised setting are that (i) a health care provider is not able to assess the difficulty of a given exercise for the patient, (ii) a health care provider is not able see how well the patient is performing the exercise (e.g., the health care provider cannot assess the patient's progress on the exercise regimens without seeing them in person), and (iii) a health care provider is not able to empirically test the implementation of evidence-based interventions.

U.S. Pat. No. 5,538,486 ("France") is directed to an instrumented therapy cord. France depicts a resistive cord attached to a stationary fixation means. Moreover, the device in France is not small form-factor and may interfere with exercise and/or add weight to the resistive cord. France does not mention data transmission; nor does France mention communication with any data-receiving device let alone including or integrating other health data.

The Rolyan® Smart Handle and Smart Handle Pro are products available from Patterson Medical. The Rolyan devices are limited in output data to the number of reps and maximum force. Moreover, the Rolyan devices are not small form-factor and may interfere with exercise and/or add weight to the resistance exercise band. Moreover, the Rolyan devices are designed to work with flat bands and may not work or are inefficient to use with other shapes and sizes of bands, such as tubing.

Little technology exists around resistance exercise bands that can detect the force generated and the force profile while doing exercise. Similarly, little technology exists in interfacing these types of devices within a body area health network. Therefore, there is a need for new devices, systems, and methods to allow for strength assessment, allowing more automated and frequent snapshots of health information to aid clinicians in patient care, particularly in a home-based setting or otherwise unsupervised setting.

SUMMARY

The present disclosure provides devices, methods, and systems for noninvasive, accurate remote monitoring of progressive physical therapies for a patient.

In one aspect, this disclosure provides a sensor-based, mobile health (mHealth) system for the remote monitoring of resistance exercises performed by a patient. In certain embodiments the patient is undergoing physical therapy. In some such embodiments, the physical therapy is intended to treat a condition, such as sarcopenia, orthopedic injury, or inpatient recovery.

In certain embodiments, the system comprises a smart resistance exercise device, wherein the exercise device is configured to connectively couple to a local data receiving device. In some such embodiments, the smart resistance exercise device comprises a resistance band and a resistance measurement device, such as a potentiometer, connected to the band. In some such embodiments, the local data receiving device includes an application configured to capture, track, monitor, and generate visual data that corresponds to individual exercises performed and force data collected while using the instrumented resistance exercise device. The application may enable direct patient feedback, clinical monitoring of patient compliance and progress, and serve as a platform for more advanced and novel operations including automatic exercise-type classification to ease user burden (i.e., minimizing required interactions between the user and mobile device) and confirm that the exercise is being performed correctly.

In certain embodiments, the resistance measurement device is a potentiometer. In some such embodiments, the potentiometer is a linear potentiometer. Thus, in certain embodiments, the smart resistance exercise device utilizes a linear potentiometer to detect elastic strain (which is ultimately converted to a force measurement through a calibration procedure). This approach constrains multi-axial loads produced during resistance exercises to a single dimension, allowing for more valid and reliable measurements (then previously developed approaches). When the loads are not linearized, variation can occur due to the angle in which the exercise is performed, leading to unreliable measurements.

In certain embodiments, the resistance measurement device is connected to the resistance band with a clamp, such as a nylon cable clamp. In some such embodiments, the nylon cable clamp is bound to a potentiometer wiper.

In certain embodiments, the system utilizes machine learning algorithms to track data, automatically determine the force exerted by the user, and/or classify the type of exercise being performed. Automated exercise classification serves two purposes: (1) It removes the need for the user to specify the exercise type being performed which decreases user burden and decreases self-report errors; and (2) It can be used to evaluate if the exercise is being performed correctly at-home (confirming exercises are performed correctly is critical for ensuring efficacy of the at-home treatment).

In certain embodiments, the exercise device has high precision and accuracy. In certain embodiments, the exercise device has a force measurement resolution of 500 g or less, an accuracy of at least 90%, and/or a coefficient of variation of 10% or less. In some such embodiments, the exercise device has a force measurement resolution of 150 g or less, an accuracy of at least 94%, and/or a coefficient of variation of 5% or less. In an exemplary embodiment, the exercise device has a force measurement resolution of 150 g, an accuracy of 94%, and a coefficient of variation of 4.9%.

In certain embodiments, the system has the capability of providing clinically relevant data on compliance and use of exercise training with feedback that will be personalized, bridging the gap between patients and clinicians.

In any aspect or embodiment described herein, the resistance band may further comprise a first end and a second end; a first handle connected to the first end of the resistance band; and a second handle connected to the second end of the resistance band.

In any aspect or embodiment described herein, the resistance band may further comprise a force sensing assembly, where the force sensing assembly includes the resistance measurement device (e.g., linear potentiometer). In some such embodiments, the force sensing assembly is positioned between the first handle and the first end of the resistance band. The force sensing assembly may include, in addition to the resistance measurement device, a microcontroller and/or processor communicatively coupled to the resistance measurement device and configured to receive data from the resistance measurement device, and a short-range wireless communication module coupled to the microcontroller and/or processor and configured to transmit the data to a local data receiving device.

In such examples, the force sensing assembly may send and receive data and other such instructions to/from the mobile device using wireless communication technology such as Bluetooth® Low Energy (BLE), Wi-Fi®, Ultra-Wide Band (UWB), or other such communication protocol.

In some such embodiments, the communication module includes hardware and firmware to establish a wireless connection with a mobile device (e.g., a smart watch, a smart phone, a tablet computer, a laptop computer, any other such mobile device and/or combinations therein). For example, the communication module can be a wireless personal area network (WPAN) module that wirelessly communicates with a mobile device via short-range wireless communication protocols. In various embodiments, the communication module implements the Classic Bluetooth®, Bluetooth®, and/or Bluetooth® Low Energy (BLE) protocols. Additionally, or alternatively, the communication module is configured to wirelessly communicate via WiFi®, WiFI® low power, Near Field Communication (NFC), Ultra-Wide Band (UWB), and/or any other short-range and/or local wireless communication protocol (e.g., IEEE 802.11 a/b/g/n/ac) that enables the communication module to communicatively couple to the mobile device.

In one aspect, this disclosure provides a method for remote clinical monitoring of a prescribed set of exercises performed using a smart resistance exercise device. The method comprises connecting a force sensing assembly of the instrumented resistance exercise device, via a processing and communication module, to a local data receiving device; recording a force profile generated by a patient performing a resistance exercise using the instrumented resistance exercise device; transmitting the force profile, via the processing and communication module, to the local data receiving device; and transmitting, via the local receiving device, the force profile to a remote data server, wherein the force profile on the remote data server is accessed and analyzed by a health care provider via a network, and wherein analysis of the force profile enables the health care provider to adjust the prescribed set of exercises for the patient.

In one aspect, this disclosure provides a smart resistance exercise device configured to connectively couple to a local data receiving device. The local data receiving device includes an application configured to capture, track, monitor, and generate visual data that corresponds to individual exercises performed and force data collected while using the smart resistance exercise device. Furthermore, the application of the local receiving device may be configured to generate visual data or other such output that corresponds to a resistance of the exercise band used while performing exercises with the instrumented resistance exercise device.

In one aspect, this disclosure provides a remote-sensing, Bluetooth-enabled resistance exercise band that can accurately gauge force through a potentiometric sensor rigidly fixed to elastic-tubing purposely designed for resistance training. Such a device provides integrated force monitoring and internet-connectivity. In certain embodiments, a corresponding mobile application and cloud-based platform provides computational resources for data visualization, storage and analysis, which will enable direct patient feedback, clinical monitoring of patient compliance and progress, and serve as a platform for more advanced and novel operations.

DETAILED DESCRIPTION

Figure 1:
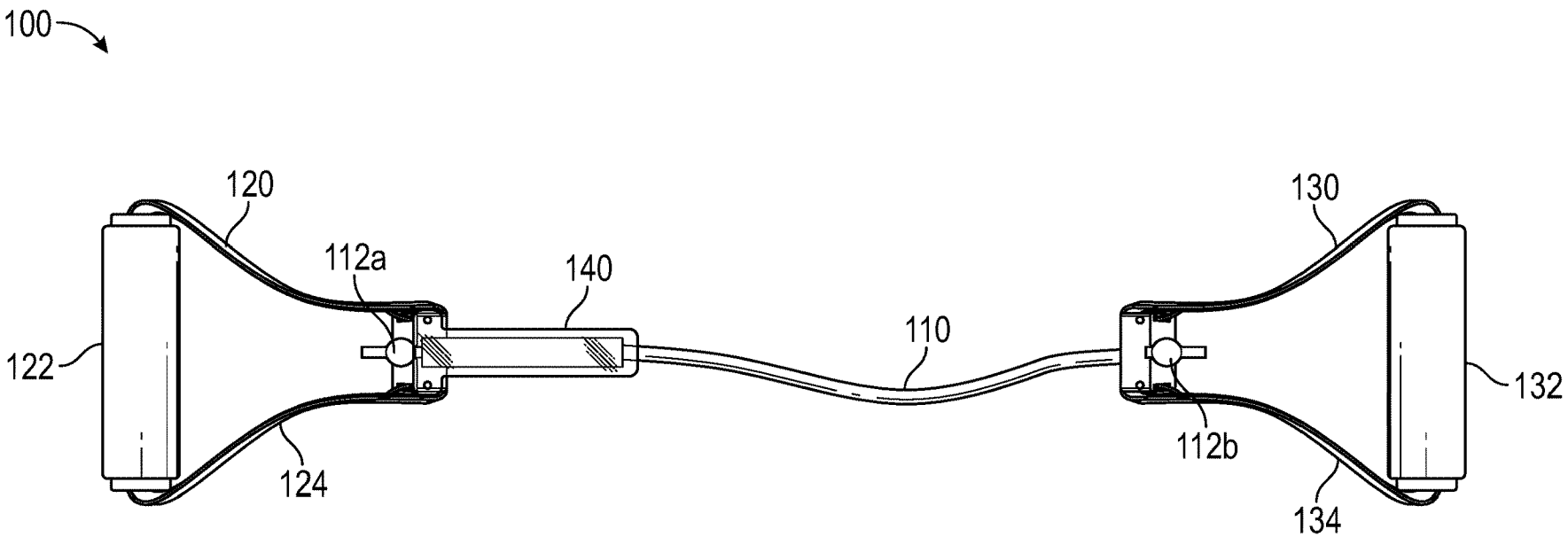
FIG. 1 is a side perspective view of one example embodiment of a resistance band device of the present disclosure.

While the features, devices, methods, and systems described herein may be embodied in various forms, the drawings show and the specification describe certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, attached, connected, coupled, and the like, are not intended to be limited to direct mounting methods but should be interpreted broadly to include indirect and operably mounted, attached, connected, coupled, and like mounting methods. This specification is intended to be taken as a whole and interpreted in accordance with the principles of the present disclosure and as understood by one of ordinary skill in the art.

Resistance exercise bands are increasingly being incorporated into clinical weight loss programs, musculoskeletal injury rehabilitation programs, and other such exercise programs because resistance training can mitigate the trajectory of muscle mass and bone density loss that can occur as a result of dieting, injury, and aging. Furthermore, resistance exercise bands are increasingly being used remotely from a clinical setting. That is, patients and/or users are directed to use the resistance exercise bands while at home or other such remote setting. However, adherence to such remote-based treatments cannot be reliably ascertained by clinicians because it can be difficult for clinicians to accurately monitor patient compliance outside of the clinical setting.

Various embodiments of the devices, methods, and systems disclosed herein include an instrumented resistance exercise device for recording, transmitting, and analyzing a force profile generated by a patient performing a variety of resistance exercises. Examples disclosed herein support remote clinical monitoring of patients via a body area network or home area network configured for use with a health monitoring system. More specifically, the remote clinical data collection and monitoring system includes, in part, the smart resistance exercise device provided to patients for exercise and rehabilitation use outside of a clinic or hospital setting. For example, patients may be taught to properly perform exercises using the smart resistance exercise device when they see their physician, physical therapist or other health care provider in a controlled clinical or laboratory setting. The patients may be provided a smart resistance exercise device to take with them to use while performing a prescribed exercise routine at home or other such non-controlled setting (e.g., outside of clinic). While home-based exercise programs consisting of resistance exercises may be prescribed and encouraged by health care providers, there is no easy way for which the physician, physical therapist or other such health care provider can monitor the patient's progress. Furthermore, it is difficult for patients and health care providers to keep track of performed exercise data such as exercise duration and repetition frequency. Such data may be useful to monitor and evaluate the progress efficacy of such home-based exercise programs.

Thus, various embodiments disclosed herein may help address prior limitations of home-based exercise programs by providing a smart resistance exercise band device that integrates a resistance measurement device and wireless communication device into the resistance exercise band device. Data collected by the smart resistance exercise band device may be transmitted to remote health care providers to and enable the health care providers to: review daily physical therapy and/or resistance exercise activity performed remotely; remotely analyze the quality of exercises performed during physical therapy and/or resistance exercise activity; individualize and/or tailor a physical therapy and/or resistance exercise plan to better meet patient needs; provide encouragement to patients to stay on track with prescribed physical therapy and/or resistance exercise regimens; and provide feedback to patients should exercise performance goals not be met.

As used herein a "smart resistance exercise device" refers to a remote-sensing and wireless communicating resistance exercise band system that provides clinically relevant data on compliance and use of exercise training with feedback that can be personalized to the user of the smart resistance exercise device. For example, a smart resistance exercise device includes a handle connected at each end of an elastic band or tubing and a force sensing assembly connected to one end of the elastic band or tubing. As the band or tubing is displaced or stretched during exercise, the force sensing assembly collects force data associated with the performed exercise and transmits the data to a remote computing device for further analysis.

As used herein, to "tether" refers to enabling a mobile device to communicatively couple with a short range communication device to send and/or receive data and instructions between the mobile device and short-range communication device. For example, a mobile device is tethered to a force sensing assembly of an instrumented resistance exercise device via wireless communication between the force sensing assembly and the mobile device. In such examples, the force sensing assembly may send and receive data and other such instructions to/from the mobile device using wireless communication technology such as Bluetooth® Low Energy (BLE), Wi-Fi®, Ultra-Wide Band (UWB), or other such communication protocol.

As used herein, a "resistance device app" and a "resistance device application" refers to a process of interacting with an instrumented resistance exercise device that is executed on a mobile device, a desktop computer, and/or within an Internet browser of a health care provider, a patient, or other such user of the instrumented resistance exercise device. For example, a resistance device application includes a mobile app that is configured to operate on a mobile device (e.g., smart watch, smart phone, a tablet computer, a wearable smart device, etc.), a desktop application that is configured to operate on a desktop computer, or a laptop computer, and/or a web application that is configured to operate within an Internet browser (e.g., a mobile-friendly website configured to be presented via a touchscreen or other user interface of a mobile device or desktop computer).

As used herein, a "network" refers to a wired and/or wireless communication connection between components and devices of an instrumented resistance exercise device and a remote clinical data collection and monitoring system. For example, a short-range wireless communication device, a mobile device, a desktop computer, a remote data server and/or other such device are configured to operate within the body area network. As such, the short-range wireless communication device, the mobile device, the desktop computer, the remote data server, and/or other such device are configured to send and receive data and other such communicated information between one another using the body area network.

Referring now to FIG. 1, an exemplary smart resistance exercise device 100 (sometimes referred to herein as the resistance band device) is shown. In the illustrated example, the resistance band device 100 includes: a resistance band 110 (sometimes referred to herein as a band or tubing), a first handle 120 operably connected to a first end of the resistance band 110; a second handle 130 operably connected to a second end opposite the first end of the resistance band 110; and a force sensing assembly 140 operably connected to the resistance band device 100 and configured to measure a force exerted on the resistance band 110 and/or first and second handles 120, 130 during use of the resistance band device 100.

In the illustrated embodiment, the first handle 120 includes a handle grip member 122 connected to a handle connection member 124. The handle connection member 124 is connected to each end of the handle grip member 122 and configured to attach or otherwise connect the first handle 120 to the first end of the resistance band 110. In the illustrated embodiment, the second handle 130 includes a handle grip member 132 connected to a handle connection member 134. The handle connection member 134 is connected to each end of the handle grip member 132 and configured to attach or otherwise connect the second handle 130 to the second end of the resistance band 110. Accordingly, a user can hold onto each of the handle grip members 122, 132 while using the resistance band device 100.

In the illustrated embodiment, the resistance band 110 is constructed out of a specified length of elastic tubing, an elastic band, or other such elastic material that extends between the first and second handles 120, 130. In one such example, a circular elastic tubing that has a diameter of 0.6 inches or less is used for the resistance band of the exercise device. In another such example, a flat elastic band that has a width of 4 inches or less is used for the resistance band of the exercise device. It will be understood that the circular elastic tubing and flat elastic band can have different dimensions (e.g., greater than 0.6 inch diameter and 4 inch width, respectively). It will be also understood that the circular elastic tubing and flat elastic band are non-limiting examples of elastic materials that can be used for the resistance band.

In various embodiments, the resistance band 110 is removably attached to the first and second handles 120, 130 such that different bands can be connected to the handles. For example, the resistance band device 100 can include different interchangeable resistance bands associated with different levels of resistance (e.g., lower resistance or greater resistance). Accordingly, the clinician or user can select a certain resistance band to connect to the first and second handles 120 and 130 based on a desired amount of resistance for performing exercises with the resistance band device 100.

In the illustrated embodiment, the first end of the resistance band 110 is connected to the handle connection member 124 of the first handle 120 via a first plug or grommet 112*a*. Similarly, the second end of the resistance band 110 is connected to the handle connection member 134 of the second handle 130 via a second plug or grommet 112*b*. In various embodiments, the first and second plugs 112*a*, 112*b* are configured to removably connect the resistance band 110 to the first and second handles 120, 130. As such, to remove the resistance band 110 from the handles 120, 130 (and attach a different resistance band), the first and second plugs 112*a*, 112*b* can be removed from the first and second end of the resistance band 110, respectively. Removal of the first and second plugs 112*a*, 112*b* enables disconnection of the resistance band 110 from the handles 120, 130 and from the force sensing assembly 140. A different resistance band can then be connected to the force sensing assembly and fixedly attached to the handles by insertion of the first and second plugs into the first and second end of the resistance band. It should be appreciated that while the interchangeable resistance bands are described as being constructed out of elastic tubing, the resistance bands can alternatively be constructed out of elastic bands or other such shapes and configurations of elastic material.

Figure 2:
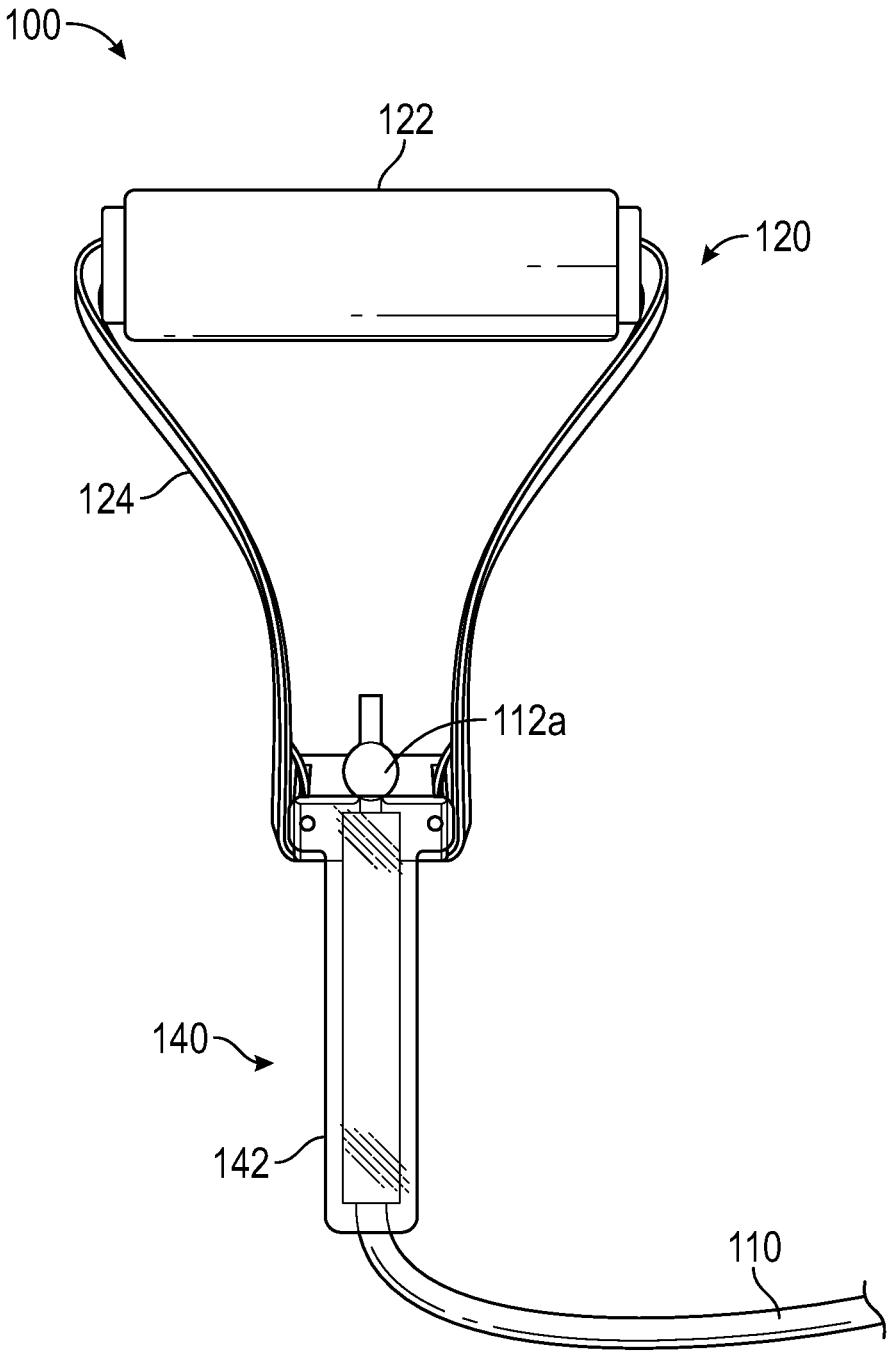
FIG. 2 is an elevational perspective view of one of the handles and the force sensing assembly of the resistance band device of FIG. 1.
Figure 3:
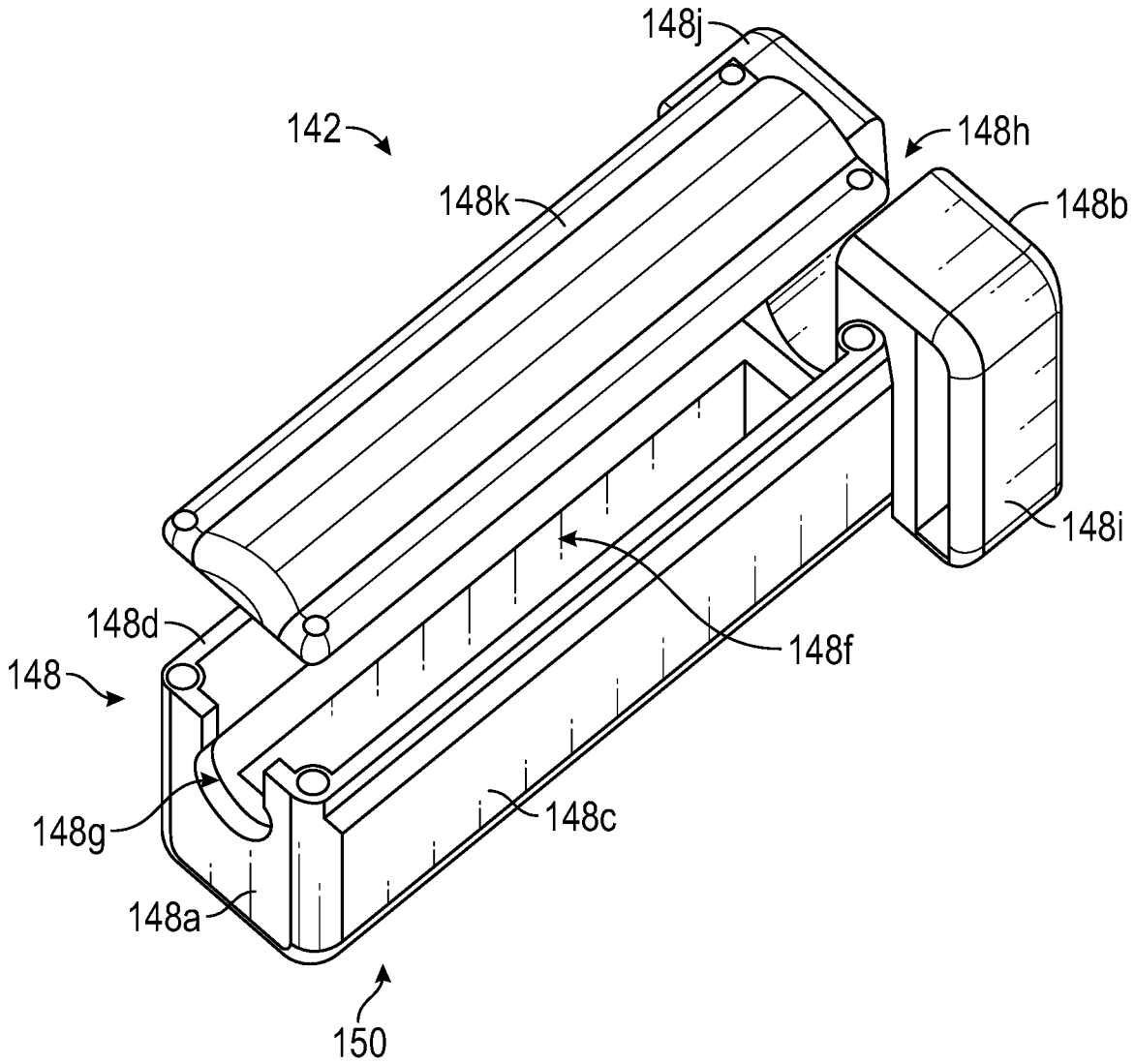
FIG. 3 is an elevational perspective view of the housing of the force sensing assembly of the resistance band device of FIG. 1.
Figure 4:
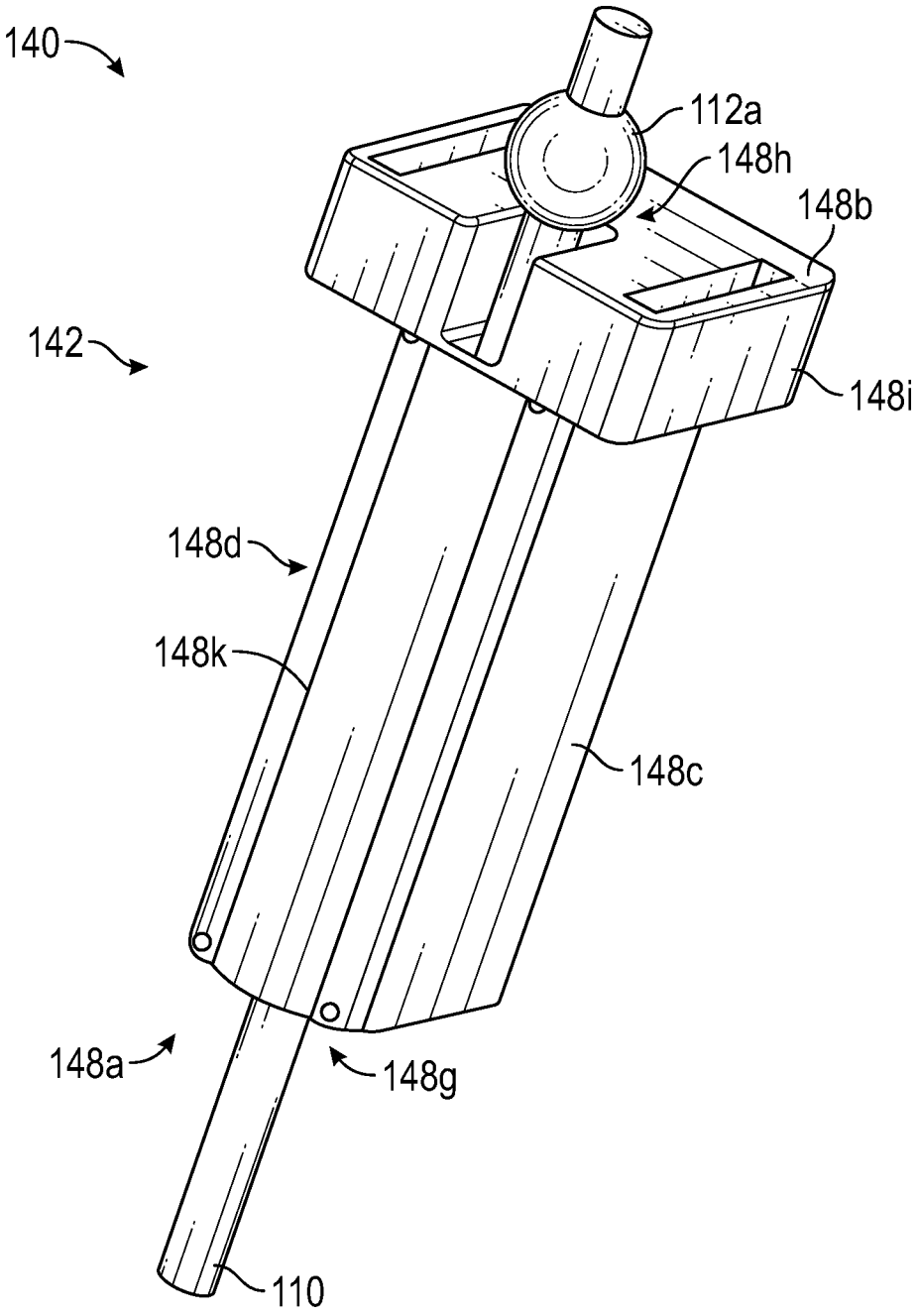
FIG. 4 is a side perspective view of the force sensing assembly of the resistance band device of FIG. 1.
Figure 5:
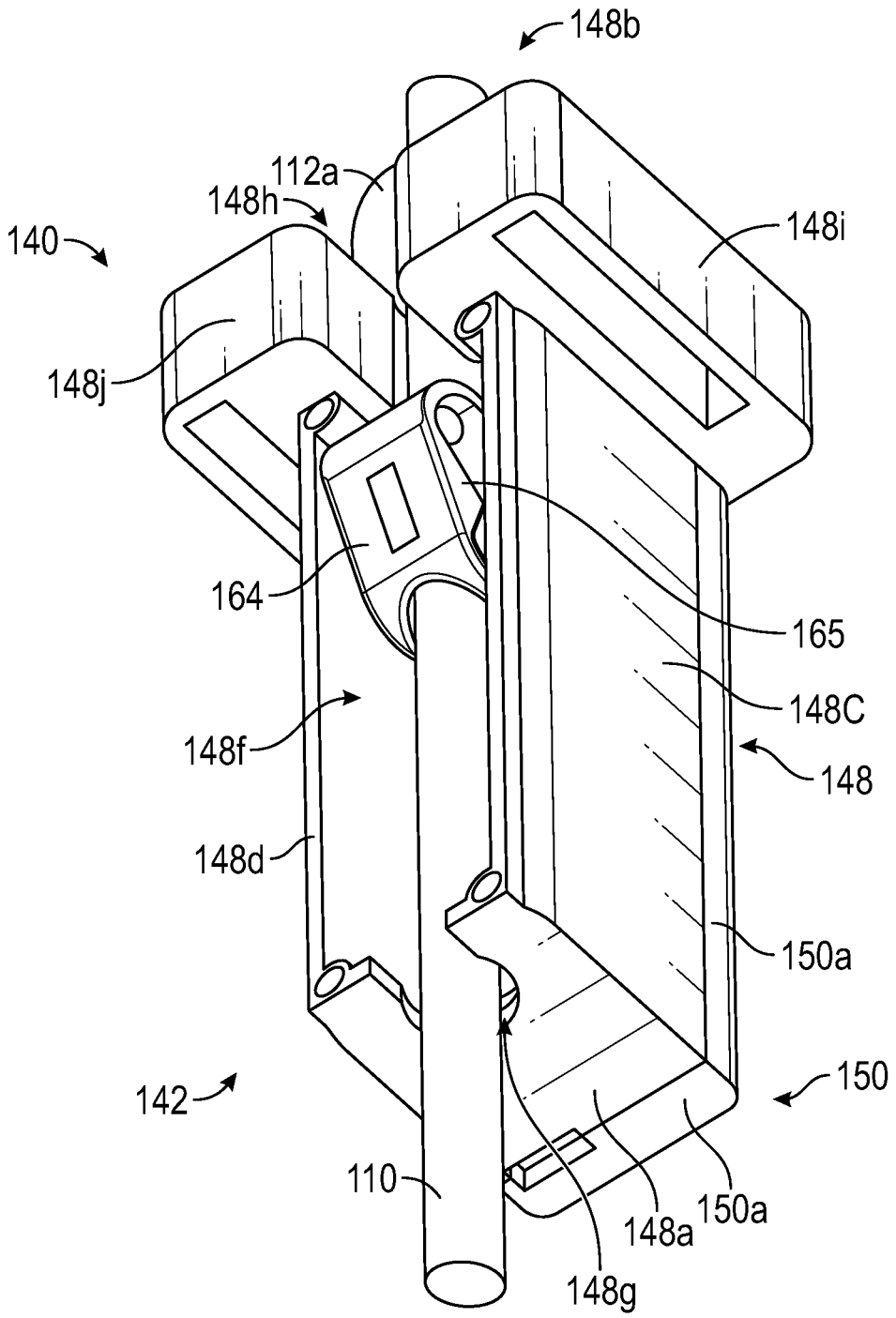
FIG. 5 is an elevational perspective view of the force sensing assembly of the resistance band device of FIG. 1, showing the attachment member is shown connected to the resistance band within the housing.

In one non-limiting example, and as best shown in FIGS. 1 and 2, the force sensing assembly 140 is attached to the first end of the resistance band 110 and positioned adjacent the handle connection member 124 of the first handle 120. As such, the force sensing assembly 140 is configured to monitor, detect, and measure a displacement of the resistance band 110 when a force is applied to the resistance band device 100 (e.g., when the first and second handles 120, 130 are stretched away from each other). It should be appreciated that while the illustrated embodiment shows the force sensing assembly 140 being connected to the first end of the resistance band 110 and adjacent the first handle 120, it should be appreciated that the force sensing assembly can alternatively be connected to the second end of the resistance band and adjacent the second handle or disposed a certain distance (e.g., centered, equal, or offset) between the first and second handles 120, 130. Furthermore, it should be appreciated that the resistance band device 100 can use more than one force sensing assembly with at least one force sensing assembly attached to each of the first and second end of the resistance band.

As best illustrated in FIGS. 2-8, the force sensing assembly 140 includes a housing 142, a force sensing device 144 disposed in the housing 142, and a processing and communication module 146 disposed in the housing 142. In the illustrated embodiment, the housing 142 includes a sensor housing portion 148 and a processor housing portion 150. In one non-limiting example, the sensor housing portion 148 includes: a bottom end wall 148*a*; a top end wall 148*b*; a right side wall 148*c*; a left side wall 148*d*, and a bottom wall 148*e* defining an open cavity 148*f* disposed therebetween and configured to receive the force sensing device 144. In the illustrated embodiment, the sensor housing portion 148 also includes a cover member 148*k* removably attached to the perimeter of the sensor housing portion 148 using fasteners (e.g., screws), a hinge, a sliding mechanism, or other attachment mechanism such that the cover member 148*k* can be removed and attached to the housing 142. Accordingly, with the cover member 148*k* in place, the sensor housing portion 148 forms an enclosure that contains or otherwise houses the force sensing device 144 of the force sensing assembly 140

In the illustrated embodiment, the bottom end wall 148*a* defines a first cylindrical bore 148*g* extending from an exterior of the bottom end wall 148*a* to the open cavity 148*f* of the housing 142. The top end wall 148*b* defines a second cylindrical bore 148*h* extending from an exterior of the top end wall 142*b* to the open cavity 148*f* of the housing 142. In the illustrated embodiment, the first cylindrical bore 148*g* is in axial alignment with the second cylindrical bore 148*h* to enable at least a portion of the resistance band 110 to enter the first cylindrical bore 148*g*, extend through the open cavity 148*f*, and exit the second cylindrical bore 148*h*.

In the illustrated embodiment, the sensor housing portion 148 includes a first arm 148*i* defined by the top end wall 148*b*. The first arm 148*i* is positioned adjacent the right side wall 148*c* and extends exterior to the right side wall 148*c*. The sensor housing portion 148 also includes a second arm 148*j* defined by the top end wall 148*b*. The second arm 148*j* is positioned adjacent the left side wall 148*d* and extends exterior to the left side wall 148*d*. In the illustrated embodiment, the top end wall 148*b*, first arm 148*i*, and second arm 148*j* form a portion of the sensor housing portion 148 that is wider than the bottom end wall 148*a*, right side wall 148*c*, and left side wall 148*d*. As such, the first and second arms 148*i*, 148*j* extend transversely exterior to the right and left side walls 148*c*, 148*d*, respectively. As best shown in FIG. 2, the first and second arms 148*i*, 148*j* enable attachment of the force sensing assembly 140 to the first handle 120 of the resistance band device 100. More specifically, the handle connection member 124 is attached to the first and second arms 148*i*, 148*j* to attach the force sensing assembly 140 to the first handle 120. It should be appreciated that while the first and second arms are shown for attachment of the force sensing assembly to the resistance band device, other suitable attachment mechanisms and methods are possible.

In various embodiments, the resistance band 110 extends through the housing 142 (via the first cylindrical bore 148*g*, second cylindrical bore 148*h*, and cavity 148*f*) such that the first end of the resistance band 110 extends out of the second cylindrical bore 148*h*. The plug 112*a* is inserted into the first end of the resistance band 110 such that the resistance band 110 cannot slip back through the second cylindrical bore 148*h*. More specifically, the plug 112*a* has a larger diameter than a diameter of the second cylindrical bore 148*h* (and the first cylindrical bore 148*g*) to keep the resistance band 110 from slipping out of the housing 142. Thus, the plug 112*a* helps to connect the force sensing assembly 140 to the resistance band 110 while also connecting the first end of the resistance band 110 to the handle connection member 124 of the first handle 120.

Figure 6:
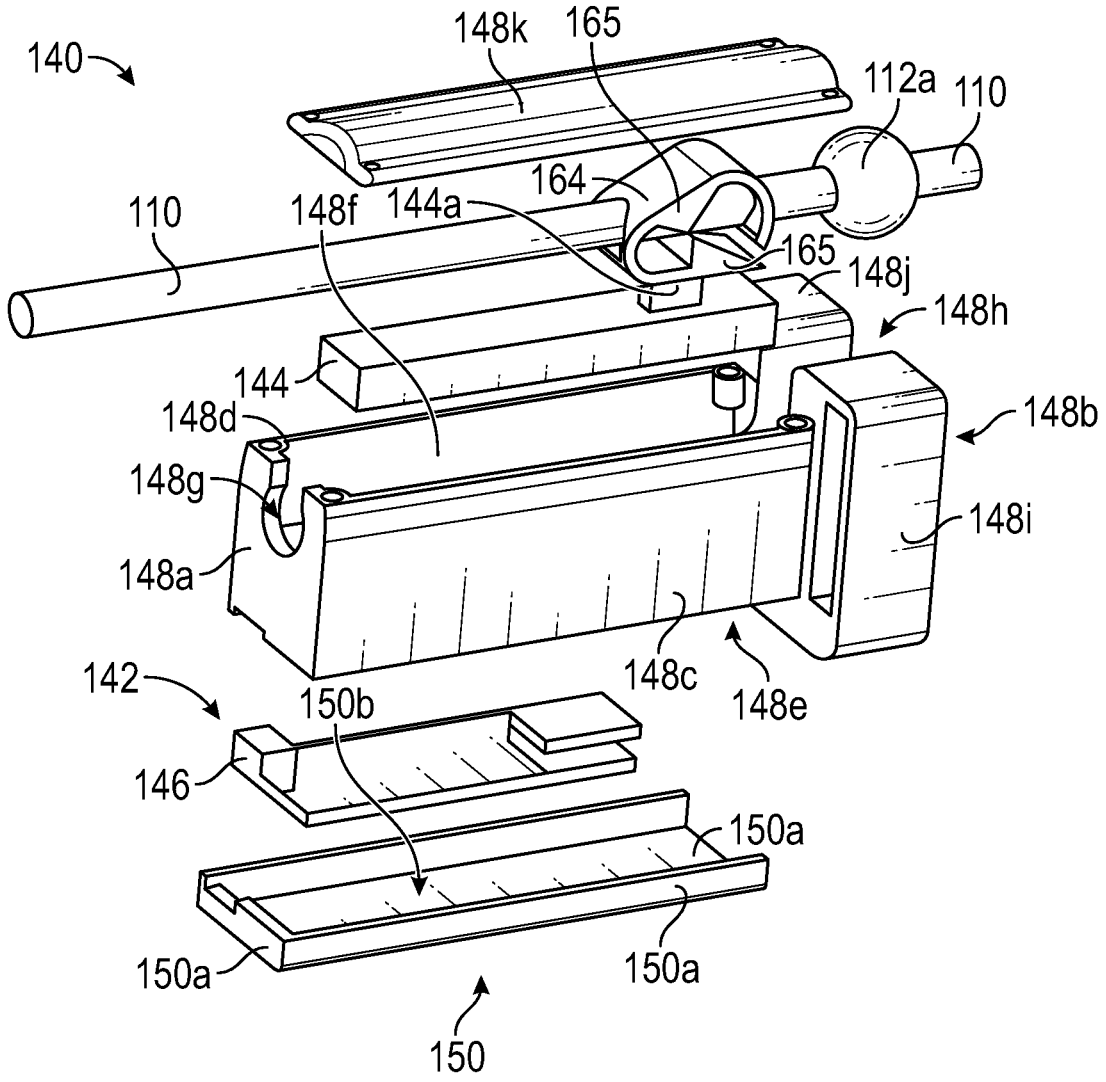
FIG. 6 is an exploded perspective view of the force sensing assembly of the resistance band device of FIG. 1, showing the attachment member connected to the resistance band and the force sensing device.
Figure 7:
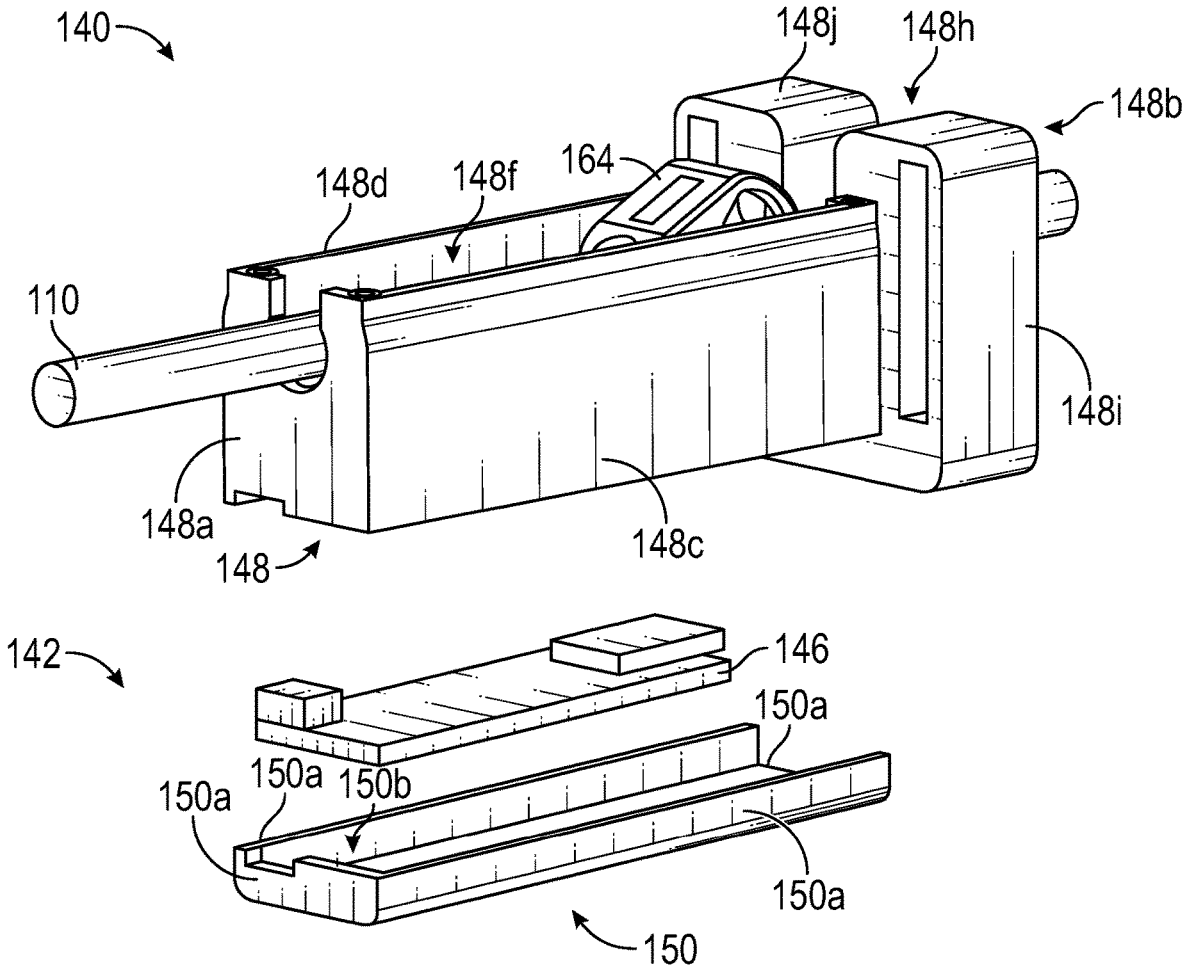
FIG. 7 is a partially exploded perspective view of the force sensing assembly of the resistance band device of FIG. 1, showing the attachment member connected to the resistance band within the housing, and showing the processing and communication module.
Figure 8:
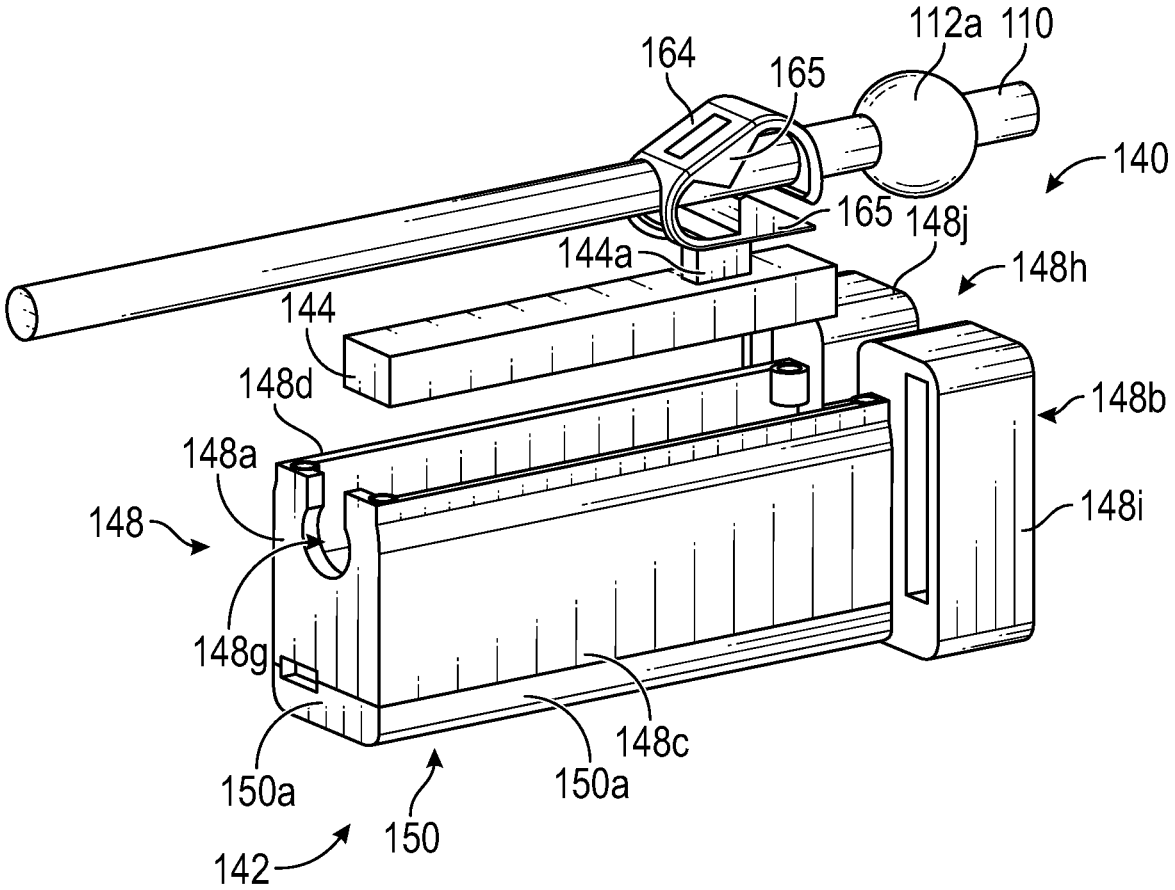
FIG. 8 is a partially exploded perspective view of the force sensing assembly of the resistance band device of FIG. 1, showing the attachment member connected to the resistance band and the force sensing device.

In certain embodiments, a linear potentiometer is used as the force sensing device 144, however it will be understood that other displacement sensors such as a rubber cord stretch sensor, a strain gauge, or other displacement sensor can be used. As best shown in FIGS. 6 and 8, the force sensing device 144 includes a wiper member 144*a* operably coupled to the resistance band 110 such that the wiper member 144*a* moves along with a displacement (e.g. elongation or contraction) of the resistance band 110 during use of the resistance band device 100. In certain embodiments, the wiper member 144*a* acts as a sliding contact that changes the force sensing device output (e.g., resistance and/or voltage) as the wiper member 144*a* slides along the force sensing device 144. In other words, the position of the wiper member 144*a* along the force sensing device 144 generates an output resistance or voltage that can be used by the processing and communication module 146 to determine an applied force to the resistance band 110 of the resistance band device 100.

As best shown in FIGS. 5-8, in certain embodiments, an attachment member 164 operably couples the wiper member 144*a* to the resistance band 110 such that the attachment member 164 and the wiper member 144*a* move simultaneously along with the resistance band 110 as the resistance band 110 is stretched or otherwise elongated. In the illustrated embodiment, the attachment member 164 is shown as a clamp that fixedly attaches to the wiper member 144*a* and the resistance band 110. In the illustrated embodiment, the resistance band 110 extends through the attachment member 164 and is positioned between cinch or pinch members 165 that grip and hold a portion of the resistance band 110 within the attachment member 164. In one non-limiting example, the attachment member 164 is configured as a compressible clamp that when in a compressed state the pinch members 165 engage or pinch the resistance band 110 to fixedly hold the resistance band 110 to the attachment member 164. Accordingly, the attachment member 164 provides a stable and secure mechanism that fixedly attaches the force sensing device 144 to the resistance band 110 such that elongation of the resistance band 110 causes a corresponding movement of the wiper member 144*a*. It will be appreciated that while the attachment member 164 is shown as a compressible clamp that fixedly attaches the wiper member to the resistance band, other attachment mechanisms are possible.

In certain embodiments, an attachment point 166 for connection of the attachment member 164 to the resistance band 110 and wiper member 144*a* is determined to ensure that the force sensing device 144 can accurately measure the displacement of the resistance band 110. More specifically, the attachment point 166 is determined to ensure that when the resistance band device 100 is stretched or elongated the wiper member 144*a* does not reach its travel limit along the force sensing device 144.

Figure 9:
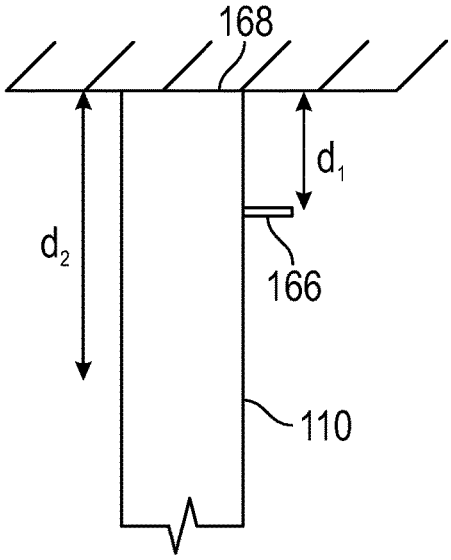
FIG. 9 is a schematic view of the attachment point of the force sensing device on the resistance band.

In one non-limiting example shown in FIG. 9, the attachment point 166 of the attachment member 164 to the resistance band 110 and force sensing device 144 is selected by determining a maximum distance ($d_1$) from a reference point 168, such as the bottom of the plug 112*a*, for attachment of the attachment member 164 to the resistance band 110 and force sensing device 144. The maximum distance ($d_1$) of the attachment point 166 from the reference point 168 can be determined by:

$$d_2=4d_1$$

where $d_2$ is the maximum travel of the linear potentiometer and $d_1$ is the maximum distance of the attachment point 166 from the reference point 168. For example, for a linear potentiometer with a maximum travel limit of 36 mm the maximum distance ($d_1$) of the attachment point 166 from the reference point 168 is 9 mm or less ($36=4d_1$). Accordingly, based on this example, to ensure proper operation of the force sensing assembly 140, the attachment member 164 should be attached to the resistance band 110 and force sensing device 144 no more than 9 mm away from the reference point 168. In certain embodiments, determination of the maximum distance ($d_1$) for the attachment point 166 also includes using a certain elongation factor of the resistance band 110 (e.g., 250%, 400%, etc.) such that the force sensing device 144 can operate within an expected elongation range during use of the resistance band device 100. Furthermore, it should be understood that since different force sensing devices may have different travel limits and different resistance bands may have different elongation factors, a different attachment point may need to be determined when changing the force sensing device and/or resistance band of the resistance band device.

Referring back to FIGS. 3-8, the processor housing portion 150 includes multiple walls 150*a* that define an open cavity 150*b* disposed therebetween and configured to receive and enclose the processing and communication module 146. In the illustrated example, the processor housing portion 150 is attached to the bottom of the sensor housing portion 148 (e.g., around perimeter of the bottom end wall 148*a*, top end wall 148*b*, right side wall 148*c*, and left side wall 148*d*). Accordingly, the housing 142 forms an enclosure between the bottom wall 148*e* of the sensor housing portion 148 and the processor housing portion 150 to contains or otherwise house the processing and communication module 146. In various embodiments, the housing 142, includes one or more ports (not shown) defined in the bottom wall 148*e* of the sensor housing portion 148, or other portion of the housing 142 to communicatively couple the processing and communication module 146 to the force sensing device 144. For example, the force sensing device 144 is communicatively coupled to the processing and communication module 146 via a connector (not shown) extending through the ports such that data collected by the force sensing device 144 can be transmitted to and received by the processing and communication module 146. Furthermore, one or more external components (e.g., power charger, external computer, mobile device) may be connected to the force sensing assembly 140 via the ports.

Figure 10:
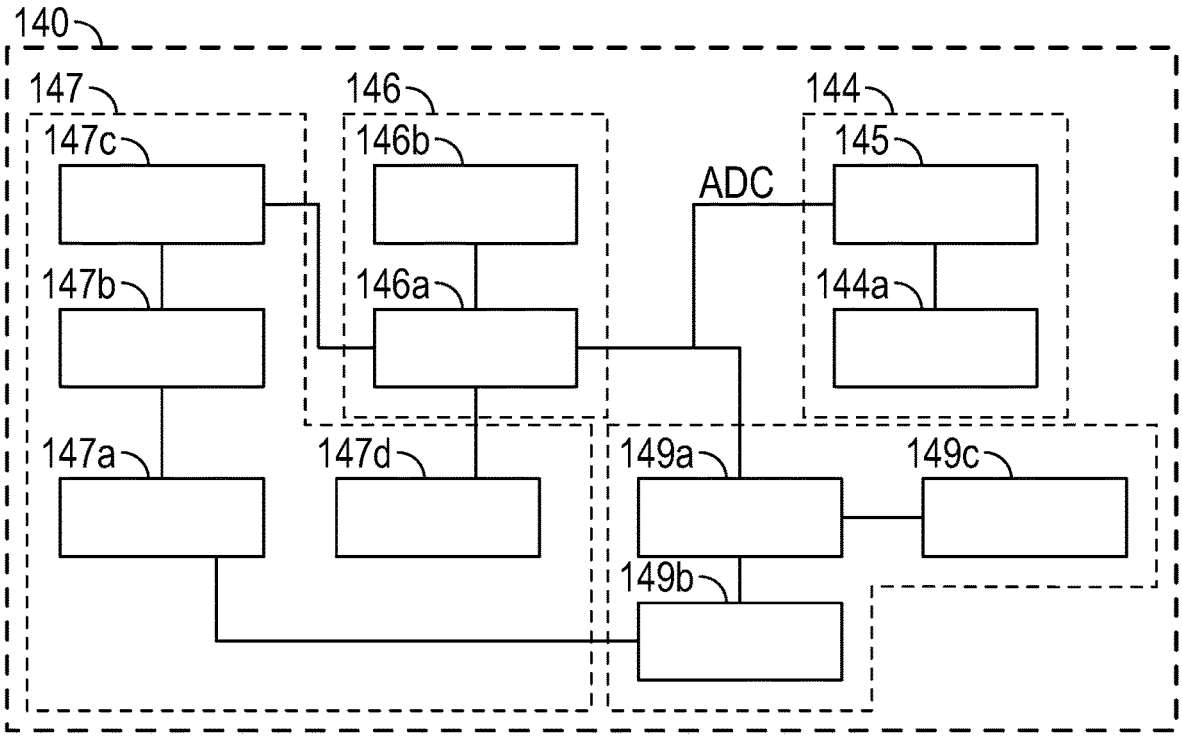
FIG. 10 is a schematic view of certain components of the force sensing assembly of the resistance band device of FIG. 1.

As shown schematically in FIG. 10, the processing and communication module 146 includes a processor 146*a* or other such processing device (e.g., microprocessor, integrated circuit, one or more field programmable gate arrays (FPGAs), and/or one or more application-specific integrated circuits (ASICs)). The processing and communication module 146 also includes a memory device (not shown) configured to store data and other such information used by the processing and communication module 146. For example, the memory device is configured to store computer readable media on which one or more sets of instructions, such as the logic or software for operating the device and executing the methods of the present disclosure, can be embedded. The memory device may also include volatile memory (e.g., RAM including non-volatile RAM, magnetic RAM, ferroelectric RAM, etc.), non-volatile memory (e.g., disk memory, FLASH memory, EPROMs, EEPROMs, memristor-based non-volatile memory, solid-state memory, etc.), unalterable memory (e.g., EPROMs), read-only memory, and/or high-capacity storage devices (e.g., hard drives, solid state drives, etc.). As such, during use of the resistance band device 100 the processor 146*a* may save data in the memory device and access instructions or other such data that is stored by the memory device.

In various embodiments, the force sensing assembly 140 further includes an analog to digital converter (ADC) (not labeled) configured to convert an analog signal to a digital signal. For example, during use of the resistance band device 100, the force sensing device 144 may output, via force sensing device circuitry 145, a resistance, voltage, or other such output signal corresponding to an amount of force measured by the force sensing device 144. The ADC converts the analog signal (e.g., voltage) to a digital signal that can be analyzed by the processor of the processing and communication module 146. Additionally or alternatively, the processing and communication module 146 may transmit the analog and/or digital signal to another computing device for further analysis.

Figure 11:
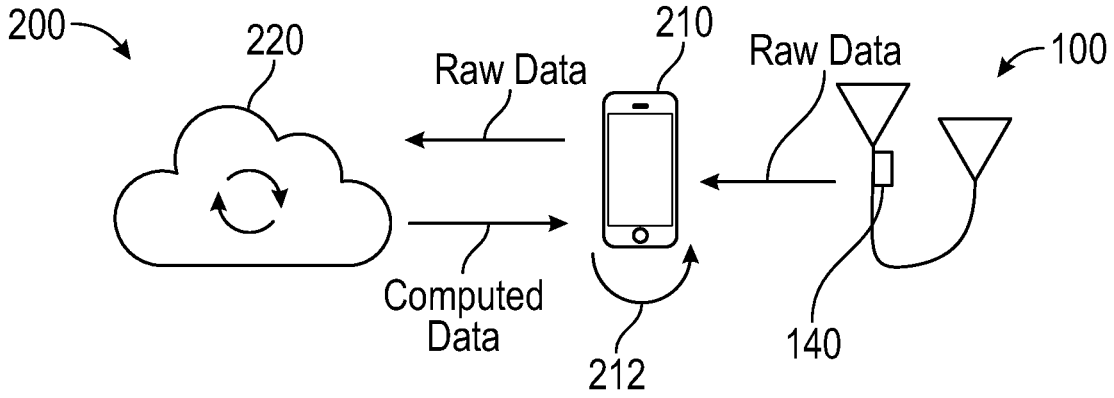
FIG. 11 is a schematic view of the remote clinical data collection and monitoring system incorporating the force sensing assembly of the resistance band device of FIG. 1.

In the illustrated example, the processing and communication module 146 includes a communication device 146*b* configured to communicatively connect the force sensing assembly 140 to one or more external computing devices (e.g., a smart watch, a smart phone, a tablet computer, a laptop computer, a desktop computer, any other such mobile device and/or combinations therein) associated with the patient or user of the resistance band device 100. For example, as shown in FIG. 11, the communication device 146*b* can be tethered to a local receiving device 210 (e.g., smart phone, smart watch, computer, etc.) of the user of the resistance band device 100. Accordingly, the communication device 146*b* of the processing and communication module 146 includes hardware and firmware to establish a wired or wireless connection between the processing and communication module 146 and the external computing device. For example, the communication device can establish a wireless personal area network (WPAN) to wirelessly communicate with the external computing device via short-range wireless communication protocols. In various embodiments, the communication device uses the Classic Bluetooth®, Bluetooth®, and/or Bluetooth® Low Energy (BLE) protocols to establish wireless communications. Additionally, or alternatively, the communication device is configured to wirelessly communicate via WiFi®, WiFI® low power, Near Field Communication (NFC), Ultra-Wide Band (UWB), and/or any other short-range and/or local wired or wireless communication protocol (e.g., IEEE 802.11 a/b/g/n/ac) that enables the communication device to communicatively couple to the external computing device.

In various embodiments, the processing and communication module 146 is communicatively coupled to the force sensing device 144 and configured to tune or otherwise calibrate the force sensing assembly 140. As such, the user of the resistance band device 100 may calibrate the force sensing device 144 prior, during, or after use of the resistance band device 100.

In various embodiments, the force sensing assembly 140 includes a power module 147 and connected to the force sensing device 144 and processing and communication module 146. In various embodiments, the power module 147 includes a rechargeable battery 147*a*, a battery charger 147*b*, a charging port 147*c*, and power module circuitry 147*d* (e.g., voltage regulator). The power module 147 is configured to provide power to force sensing assembly 140 during use of the resistance band device 100. As such, various embodiments of the force sensing assembly 140 further includes a power switch (not shown) that turns the power source on and off.

In the illustrated embodiment, the force sensing assembly 140 includes a user interface 149 that includes an on/off switch 149*a*, power level indicator 149*b*, LED indicator 149*c*, and other such interface components, (e.g., push buttons, visual display, speaker, etc.). The user of the resistance band device 100 may use the user interface 149 to monitor and/or control the force sensing assembly 140. For example, the user interface 149 can be configured to provide visual, audio, tactile, or other such feedback during use of the resistance band device 100. In other such embodiments, the user interface of the force sensing assembly 140 is displayed on a resistance device application displayed on a mobile device or other external computing device.

Certain aspects and embodiments of the force sensing assembly 140 disclosed herein provides particular advantages. For example, the small form factor of the housing 142, force sensing device 144, processing and communication module 148, and other components of the force sensing assembly 140 can minimize or prevent interference with normal resistance exercise protocols by maintaining nearly normal weight profiles and by allowing full range of motion of the resistance band device 100. Additionally, the small form factor of the housing 142, force sensing device 144, processing and communication module 146, and other components of the force sensing assembly 140 enable a more efficient connection to the resistance band device 100.

Figure 12:
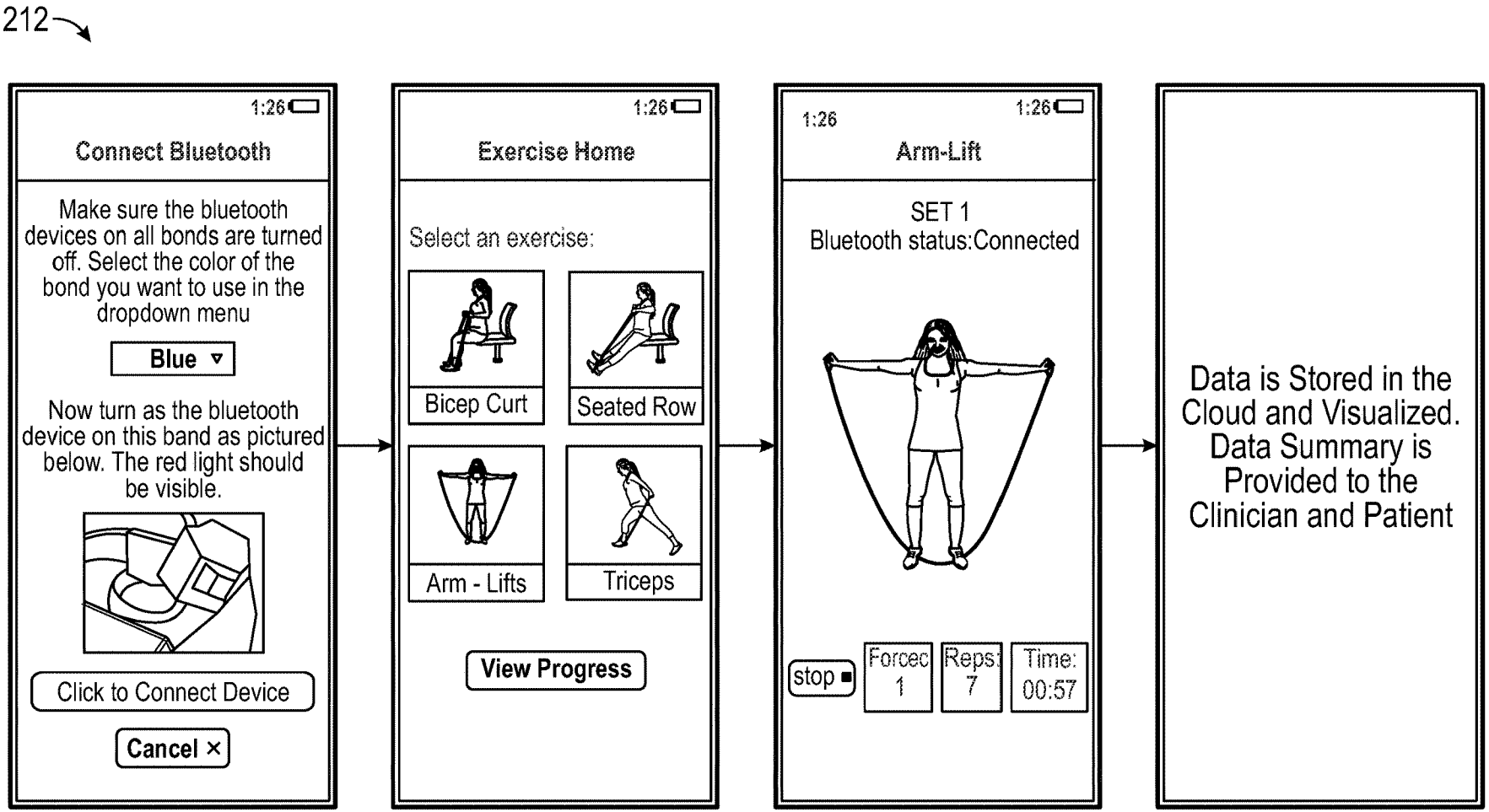
FIG. 12 is a graphical display of the resistance device application executed by a mobile device tethered to the force sensing assembly of the remote clinical data collection and monitoring system of FIG. 11.

FIGS. 11 and 12 illustrate one exemplary remote clinical data collection and monitoring system 200 which incorporates the smart resistance exercise device 100 discussed herein with remote or cloud based computing devices that can track and analyze user data, automatically determine the force exerted by the user of the smart resistance exercise device 100, determine the number of exercise repetitions performed, classify the type(s) of exercise performed by the user and other such other such data analysis. More specifically, the remote clinical data collection and monitoring system 200 includes: the smart resistance exercise device 100; the force sensing assembly 140 operatively coupled to and configured to collect force and other such data from the smart resistance exercise device 100; a mobile device 210 (sometimes referred to herein as a local receiving device) communicatively coupled to the force sensing assembly 140; and a remote data server 220 communicatively coupled with the mobile device 210 via a network.

In various embodiments, the remote clinical data collection and monitoring system 200 is configured to capture, track, monitor, and generate visual data that corresponds to individual exercises performed and force data collected while using the smart resistance exercise device 100. The force sensing assembly 140, via the processing and communication module 146, is communicatively coupled or otherwise tethered to the user's mobile device 210 (e.g., local data receiving device). As discussed herein, the processing and communication module 146 is configured to transmit the force profile and other such data collected by the force sensing device 144 to the mobile device 210 using Classic Bluetooth®, Bluetooth®, BLE or other such short-range wireless communication protocol.

In various embodiments, the mobile device 210 is configured with or otherwise includes a resistance device application 212 or other such software associated with the smart resistance exercise device 100. In such embodiments, the user may activate the resistance device application 212 on their mobile device 210 (e.g., smart watch, smart phone, or other such mobile device) before starting an exercise session with the smart resistance exercise device 100. Once activated, the resistance device application 212 can initiate a tethering sequence between the mobile device 210 and the force sensing assembly 140 of the smart resistance exercise device 100 by the display of a connection request indicating to the user that the mobile device 212 would like to tether to the force sensing assembly 140. Furthermore, while the mobile device 212 and force sensing assembly 140 execute the tethering process, the resistance device application 212 may ask the user to input certain exercise device configuration information such as the type of band to be used with the smart resistance exercise device 100 (e.g., bands having different levels of resistance), and other such configuration data.

Once the mobile device 212 is tethered to the smart resistance exercise device 100, the resistance device application 212 can display a variety of possible exercises for the patient to perform (e.g., bicep curl, seated row, arm-lifts, triceps, etc.) and enable the user to select a specific exercise to perform. Once the user enters the proper selections (e.g., resistance band type, selected exercise, etc.), the resistance device application 212 prompts the user to begin the selected exercise. As the user performs the exercise, the force sensing assembly 140 collects the force data associated with the performed exercise and sends the data to the mobile device 210. In various embodiments, the resistance device application 212 displays the data as it is received from the force sensing assembly 140. For example, the resistance device application 212 displays a force measured by the force sensing assembly 140, summarized exercise statistics (e.g., mean, minimum, and maximum force values and exercise time), a number of exercise repetitions performed, an elapsed exercise time, and any other such data associated with the exercise. Additionally, once the user completes the exercise the resistance device application 212 may display an exercise summary to the user so they can view the results. In the illustrated embodiment, when the exercise session is complete, the resistance device application 212 may prompt the user to transmit the collected data from the mobile device 210 to the remote data server 220 or other such storage location via the network.

In various embodiments, the remote clinical data collection and monitoring system 200 enables the clinician and the user to review useful summarized metrics about patient performance on exercises over time (e.g., daily, weekly, monthly, etc.). Such review may be implemented via, for example, accessing the remote data server or viewing a secure webpage accessed over the network. In some such embodiments, viewing features include the ability to review a single exercise session or daily/weekly/monthly exercise summaries broken down by a specific exercise or series of exercises. A clinician dashboard generated by the remote data server 220 can enable the clinician to remotely track a patient's progress and send direct feedback to a specific patient's mobile device 210.

In various embodiments, use of the remote data collection and monitoring system 200 by a clinician or other health care provider and a user of the smart resistance exercise device 100 involves one or more of the following: (1) a user performing one or more resistance-based exercises using the smart resistance exercise device 100; (2) the smart resistance exercise device 100 collecting and transmitting raw exercise data to the mobile device 210; (3) the mobile device 210 transmitting the received raw data, via the network, to the remote data server 220; (4) the remote data server 220 analyzing and/or summarizing the received raw data; and (4) transmitting the computed summarized data for display on the user's mobile device 210 and/or the clinician's remote computing device.

In various embodiments, the resistance device application 212 is configured as easy-to-use such that an individual with minimal experience using a mobile device can navigate and use the resistance device application 212 with minimal instruction. In various embodiments, the resistance device application 212 can be used to: (1) sign-up or login to a user's personal account; (2) display basic exercise information (e.g., name of exercise, target muscle(s), etc.); (3) display exercise demonstrations; (3) enable user to select exercise; (4) enable user to start recording/capture of raw data; (5) display historical exercise data collection; and (6) display summary of current exercise session.

In various embodiments, the resistance device application 212 and remote data server 220 use machine learning algorithms to generate models and predictions based on the raw data collected by the smart resistance exercise device 100. For example, the remote data server 220 may analyze raw data received by the mobile device 210 using data analysis algorithms such as but not limited to, vector machine regression, random forest regression, elastic net regression, and other such time series analysis algorithms. In such embodiments, the remote clinical data collection and monitoring system 200 uses the machine learning algorithms to track data, automatically determine the force exerted by the user, and/or classify the type of exercise being performed. Such automated exercise classification serves two purposes: (1) It removes the need for the user to specify the exercise type being performed which decreases user burden and decreases self-report errors; and (2) It can be used to evaluate if the exercise is being performed correctly at-home (confirming exercises are performed correctly is critical for ensuring efficacy of the at-home treatment).

In various embodiments, the remote data collection and monitoring system 200 enables the clinician to remotely monitor progress of a patient treatment plan. Such remote monitoring capabilities enables the clinician and/or other health care provider, to: (1) review daily physical therapy activity via, for example, a wireless, Bluetooth modality; (2) remotely evaluate the quality of the exercises performed; (3) allow individualization and tailoring of a fitness and strength training plan to better meet the patient's needs; (4) remotely provide encouragement to stay on track with the patient's exercise regimen(s); and (5) remotely encourage the patient to push themselves should treatment and/or progress goals not be met. In various embodiments the remote data collection and monitoring system 200 enables the clinician to monitor and tailor the patient's treatment plan while the patient performs the exercises in a remote (e.g., home-based, or otherwise unsupervised) setting. These advantages are particularly useful in rural and/or remote regions that have broadband or cellular access enabling transmission of data to healthcare settings at a distance away. As such, patients in rural and/or remote settings may gain access to care and feedback that was otherwise difficult or impractical to obtain.

In various embodiments, the remote data and collection system 200 enables the user and/or the clinician to calibrate the smart resistance exercise device 100 to set up and/or confirm that the force sensing assembly 140 collects data that accurately and repeatably corresponds to a displacement (e.g., stretching) of the resistance band. One such exemplary calibration procedure includes operatively connecting the handles and the force sensing assembly 140 to the resistance band and placing one or more loads onto the smart resistance exercise device 100.

For example, once the smart resistance exercise device 100 is assembled, known loads can be placed on the smart resistance exercise device 100 to cause a corresponding displacement of the resistance band and force sensing assembly 140. In one such example, a set of known weights can be incrementally attached to (and removed from) the smart resistance exercise device 100 to generate an output voltage of the force sensing assembly 140 during the displacement of the resistance band. As such, the output voltage of the force sensing assembly 140 for each load (e.g., known weight) can be used to calculate an applied force on the smart resistance exercise device 100 for that load. The calculated applied force can then be analyzed to further determine if the applied force falls within an expected range for the applied load. If the calculated applied force does fall within the expected range, the remote data and collection system 200 is operating as expected. Conversely, if the calculated applied force falls outside of the expected range, the remote data collection system 200 is not operating as expected. In such instances, the user and/or clinician may be prompted to repeat the calibration procedure.

In certain embodiments, the remote data and collection system 200 saves the calibration data to perform a historical analysis over time of the calculated applied force for each load. For example, the remote data and collection system 200 can notify and/or instruct the user to perform the calibration procedure at a specified interval (e.g., once a month, every three months, etc.) and/or after a certain amount of resistance band use (e.g., 1000 exercise repetitions, 3000 exercise repetitions, certain amount of band elongation etc.). Additionally, or alternatively, the system can notify and/or instruct the user to perform the calibration procedure based on any modifications is made to the smart resistance exercise device 100 (e.g., when one resistance band is changed out for another), environmental changes (e.g., temperature changes to exercise area), and/or other such changes to the smart resistance exercise device 100.

In certain embodiments, the remote data and collection system 200 can use the calibration data, exercise data, and any other data collected by the smart resistance exercise device 100 to notify and/or instruct the user to perform the calibration procedure of the smart resistance exercise device 100. For example, if the remote data and collection system 200 determines that a specified interval (e.g., two weeks, one month, three months, etc.) has passed since the last calibration, and/or determines that a specified exercise repetition threshold (e.g., 1000 exercise repetitions or band elongation cycles) has been reached since the last calibration, the remote data and collection 200 can prompt the user to re-calibrate the smart resistance exercise device 100. In such embodiments, the user can attach one or more known weights to the device and measure the displacement of the resistance band and force sensing assembly 140 to ensure the smart resistance exercise device 100 is working as intended. Additionally, calibration data, exercise data, and any other data collected by the smart resistance exercise device 100 can be used to monitor the status of the resistance band to indicate if the band is near the end of its life, if the user may benefit from using a band with increased/decreased resistance, or other such reason. As such, the remote data and collection system 200 can notify the user to change or replace the current resistance band of the smart resistance exercise device 100.

Accordingly, the device, methods and systems described herein may be implemented over or as part of a body area health network. In some such embodiments, resistance exercise data can be combined with other information, such as other physiological data or environmental data. In some such embodiments, resistance exercise data, and, optionally, the other information, is accessible to a health care provider, for example by using wireless, real-time data communication to transmit the data to the health care provider's network. In some such embodiments, a health care provider can review resistance exercise data, and, optionally, the other information, and subsequently provide feedback remotely, for example to the patient's local data-receiving device.

What is claimed is:

1. A smart resistance exercise device comprising:

a resistance band having a first end and a second end;

a first handle connected to the first end of the resistance band;

a second handle connected to the second end of the resistance band;

a force sensing assembly operably coupled to the resistance band, the force sensing assembly comprising:

a housing;

a force sensor disposed in the housing and operatively connected to the resistance band and configured to measure a force exerted on the resistance band, a processing and communication module communicatively coupled to the force sensor and configured to receive a data set associated with the force measured by the force sensor, and a local receiving device communicatively coupled to the processing and communication module, the processing and communication module configured to transmit the data set associated with the force measured by the force sensor to the local data receiving device, wherein the housing comprises a first outer surface defining a first bore and a second outer surface defining a second bore, and wherein the first bore is in axial alignment with the second bore, wherein the resistance band extends through the first bore and the second bore such that a portion of the resistance band is enclosed in the housing, wherein the force sensor comprises a linear potentiometer including a wiper member, and wherein the wiper member is operably connected to the portion of the resistance band enclosed in the housing, and wherein an attachment member operably couples the wiper member to the resistance band such that the attachment member and the wiper member move simultaneously along with the resistance band.

2. The smart resistance exercise device of claim 1, wherein the processing and communication module comprises a Bluetooth Low Energy (BLE) module communicatively coupled to the local data receiving device.

3. The smart resistance exercise device of claim 1, wherein the force sensor comprises a linear potentiometer.

4. The smart resistance exercise device of claim 3, wherein a wiper member of the linear potentiometer is operatively connected to the resistance band.

5. The smart resistance exercise device of claim 1, wherein the housing comprises a first arm extending outward from a first sidewall and a second arm extending outward from a second sidewall, and wherein the first and second arms connect the housing to the first handle.

6. The smart resistance exercise device of claim 1, wherein, an attachment point is determined for attachment of the wiper member to the resistance band such that the wiper member does not reach a travel limit during elongation of the resistance band.

7. A remote data collection system comprising:

a smart resistance exercise device comprising:

a resistance band, and a force sensing assembly operatively coupled to the resistance band, the force sensing assembly comprising:

a housing;

a force sensor disposed in the housing and operatively connected to the resistance band and configured to measure a force exerted on the resistance band, and a processing and communication module communicatively coupled to the force sensor and configured to receive a data set associated with the force measured by the force sensor, a local receiving device communicatively coupled to the processing and communication module and configured to receive the data set associated with the force measured by the force sensor; and a remote data server communicatively coupled with the local receiving device via a network and configured to receive the data set associated the force measured by the force sensor from the local receiving device, wherein the housing comprises a first outer surface defining a first bore and a second outer surface defining a second bore, and wherein the first bore is in axial alignment with the second bore, wherein the resistance band extends through the first bore and the second bore such that a portion of the resistance band is enclosed in the housing, wherein the force sensor comprises a linear potentiometer including a wiper member, and wherein the wiper member is operably connected to the portion of the resistance band enclosed in the housing, and wherein an attachment member operably couples the wiper member to the resistance band such that the attachment member and the wiper member move simultaneously along with the resistance band.

8. The remote data collection system of claim 7, wherein the processing and communication module comprises a Bluetooth Low Energy (BLE) module communicatively coupled to the local data receiving device.

9. The remote data collection system of claim 7, wherein the housing comprises a first arm extending outward from a first sidewall and a second arm extending outward from a second sidewall, and wherein the first and second arms connect the housing to a first handle of the smart resistance exercise device.

10. The remote data collection system of claim 7, wherein, an attachment point is determined for attachment of the wiper member to the resistance band such that the wiper member does not reach a travel limit during elongation of the resistance band.

11. A force sensing assembly operably coupled to a resistance band, the force sensing assembly comprising:

a housing including a first outer surface defining a first bore and a second outer surface defining a second bore, the first bore being in axial alignment with the second bore such that the resistance band extends through the first bore and the second bore of the housing;

a force sensor disposed in the housing and operatively connected to the resistance band and configured to measure a force exerted on the resistance band, a processing and communication module communicatively coupled to the force sensor and configured to receive a data set associated with the force measured by the force sensor, wherein the force sensor comprises a linear potentiometer including a wiper member, and wherein an attachment member operably couples the wiper member to the resistance band such that the attachment member and the wiper member move simultaneously along with the resistance band.

* * * * *